US005305814A

United States Patent [19]

Ford et al.

[11] Patent Number: 5,305,814

[45] Date of Patent: Apr. 26, 1994

[54] METHOD FOR FORMING A BISHOP TAIL AND BISHOP SLEEVE

[75] Inventors: James A. Ford; William L. Tacchella, both of Sturgis, Mich.

[73] Assignee: Cooper Industries, Inc., Houston, Tex.

[21] Appl. No.: 988,041

[22] Filed: Dec. 9, 1992

[51] Int. Cl.[5] ..... A47H 1/00

[52] U.S. Cl. ..... 160/348; 160/349.2

[58] Field of Search ..... 160/349.1, 349.2, 348, 160/19, 38, 84.1, 330, 405, 108, 123, 124, 327, 368.1, 354

[56] References Cited

U.S. PATENT DOCUMENTS

| | | | |
|---|---|---|---|
| 2,409,425 | 10/1946 | Falkenberg | 160/84 |
| 2,435,183 | 1/1948 | Pezzella | 160/84 |
| 2,498,925 | 2/1950 | Lind | 160/348 |
| 2,524,426 | 10/1950 | Comerford et al. | 160/348 |
| 2,557,578 | 6/1951 | Stallone | 160/348 |
| 2,588,203 | 3/1952 | Cameron | 160/348 |
| 2,588,246 | 3/1952 | Kenney | 160/330 |
| 2,606,733 | 8/1952 | Krajewski | 248/215 |
| 2,607,412 | 8/1952 | Vance et al. | 160/348 |
| 2,637,384 | 5/1953 | McCabe | 160/348 |
| 3,203,469 | 8/1965 | Falkenberg | 160/348 |
| 4,284,258 | 8/1981 | Kleiman | 248/251 |
| 4,958,646 | 9/1990 | Hannenshg | 160/348 |
| 5,018,567 | 5/1991 | Hannerstig | 160/348 |
| 5,078,199 | 1/1992 | Hannerstig | 160/348 |
| 5,146,972 | 9/1992 | Tacchella | 160/330 |

*Primary Examiner*—David M. Purol

*Attorney, Agent, or Firm*—Alan R. Thiele; Eddie E. Scott; William B. Patterson

[57] ABSTRACT

An improved method for draping curtains which allows one person to form a decorative window treatment known as a bishop tail without requiring any specialized skills or training. The method described hereinafter allows a fabric scarf to be draped from a rod of conventional configuration in a decorative manner about a window opening. The method uses hook and loop type fasteners means to secure the fabric scarf to the rod and thereby prevent the fabric scarf from sagging at the top. Curtain rings are placed over the ends of the depending fabric scarf and then installed on the rod near its ends to allow a portion of the fabric scarf to form a decorative downwardly curved arc of fabric. The newly formed arc is then "dressed" or folded into pleats in accordance with the teaching of U.S. Pat. No. 5,146,972 to William L. Tacchella. A hook closure ring is then installed through the previously hemmed edges of the fabric scarf and hung by a cord from the wall bracket to form the bishop tail.

An alternate embodiment is shown with a pair of bishop sleeves placed below the previously described bishop tail of the preferred embodiment. A second section of fabric scarf is hemmed on one edge and hung by a hook closure ring from the bracket behind the first bishop sleeve. The depending portion of the draped end of the fabric scarf is gathered and placed within a hook closure ring. The hook closure ring is then suspended by a pinch ring from the rear of the fabric scarf to form a bishop sleeve. The process is then repeated for the other side of the window.

12 Claims, 4 Drawing Sheets

FIG. 1
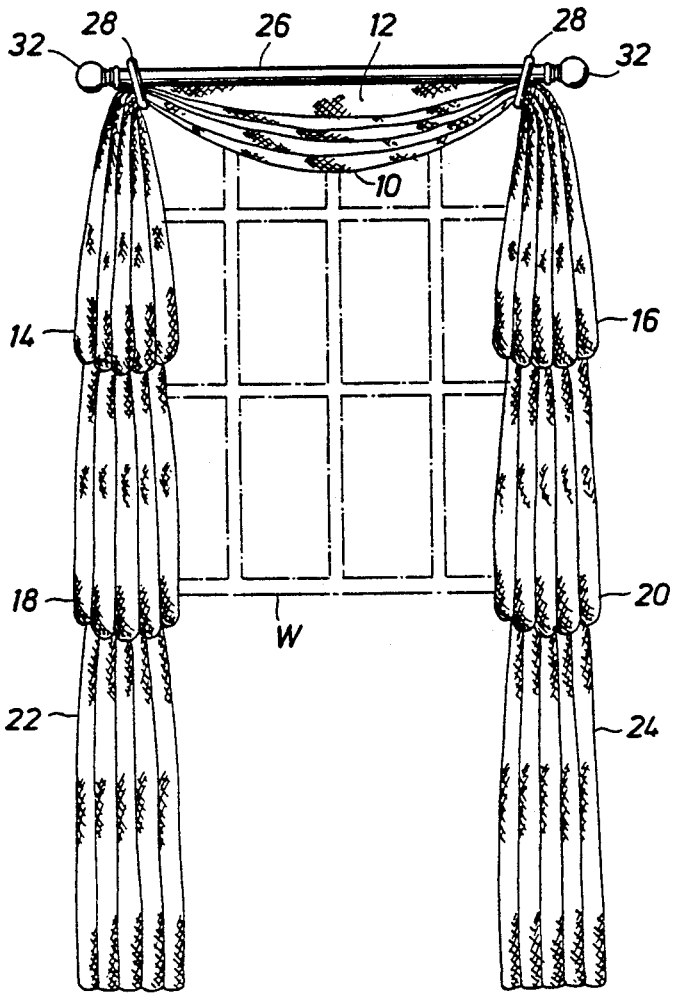
FIG. 2
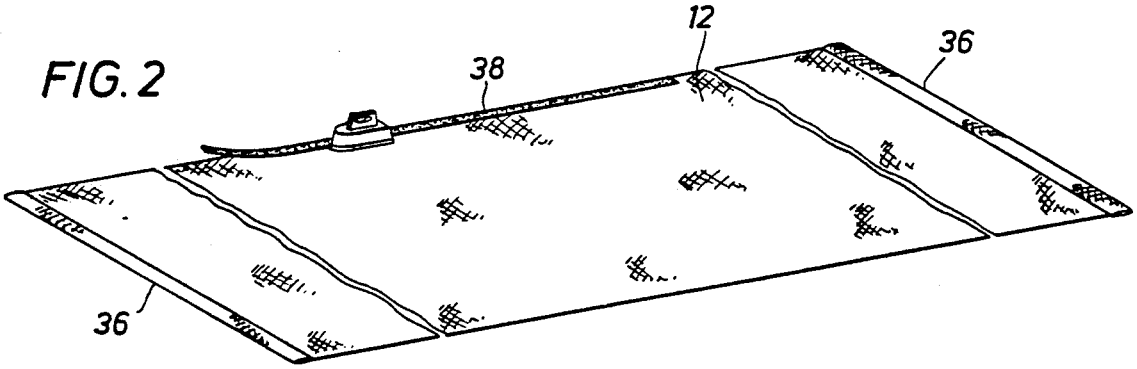
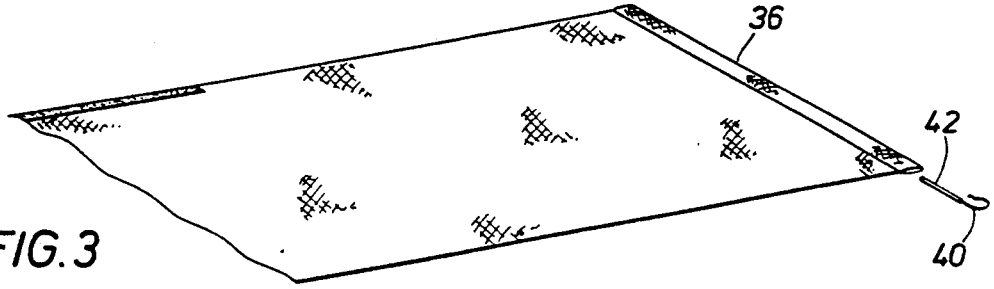
FIG. 3

METHOD FOR FORMING A BISHOP TAIL AND BISHOP SLEEVE

BACKGROUND

This invention relates to a method for draping curtains to provide a custom designed wall or window look quickly and inexpensively. Typically a window curtain is supported over a window on a horizontal rod attached to the wall with the curtain fabric hanging therefrom. A decorative embellishment added to these window treatments is to drape the end portion of the curtain in a decorative puff referred to as a bishop tail. The present invention provides a method for draping and dressing the curtain fabric which can be easily performed by one person without requiring any special skills.

A second embellishment commonly known as a bishop sleeve can be used in conjunction with the bishop tail. This embellishment includes a second section of curtain fabric hung from the curtain bracket behind the first bishop tail. The depending portion of the draped end of the curtain fabric is gathered and draped in an ornamental fashion below the bishop tail. The process is then repeated for the other side of the window. This embellishment requires a considerable degree of skill to execute properly. In particular, in the past it was necessary to hem the fabric at a pre-determined location and carefully loop a cord or similar device through the hem to form the bishop sleeve decorative treatment. This prior method was difficult to implement since considerable skill was required to place the hem for each side of the curtain in the correct position to ensure each side of the curtain was evenly draped.

U.S. Pat. No. 4,284,258 to S. Kleiman discloses a festoon support device composed of a pair of specially shaped brackets secured to a wall for supporting a curtain in a festoon configuration.

U.S. Pat. No. 4,958,646 to C. Hannerstig discloses a method for draping curtains utilizing a special bracket from which the curtain fabric is draped. The special bracket further allows an ornamental fabric rosette to be formed on the special bracket without special skill or assistance.

U.S. Pat. No. 5,018,567 to C. Hannerstig, a continuation-in-part of U.S. Pat. No. 4,958,646, further defines a method for forming tie-back puffs utilizing the aforementioned special bracket.

U.S. Pat. No. 5,146,972 to W. Tacchella discloses a method for draping curtains which allows a person to form a decorative window treatment without requiring any specialiized skills or training.

SUMMARY

An improved method for draping curtains which allows one person to form a decorative window treatment known as a bishop tail without requiring any specialized skills or training. The method described hereinafter allows a fabric scarf to be draped from a rod of conventional configuration in a decorative manner about a window opening. The method uses hook and loop type fastening means to secure the fabric scarf to the curtain rod and thereby prevent the curtain from sagging at the top. Curtain rings are placed over the ends of the depending fabric scarf and then installed on the rod near its ends to allow a portion of the fabric scarf to form a decorative downwardly curved arc of fabric. The newly formed arc is then "dressed" or folded into pleats in accordance with the teaching of U.S. Pat. No. 5,146,972 to William L. Tacchella. A hook closure ring is then installed through the previously hemmed ends of the fabric scarf and hung by a pinch ring from the rear of the fabric scarf to form the bishop tail. An alternate embodiment uses a cord hung from the wall bracket in place of the pinch ring.

A second embellishment known as a bishop sleeve is shown placed below the previously described bishop tail of the preferred embodiment. A second section of fabric scarf is hemmed on one edge and hung by a hook closure ring from the bracket behind the bishop tail. The depending portion of the draped end of the fabric scarf is gathered and placed within a hook closure ring. The hook closure ring is then suspended from a hook installed in the wall behind the bishop sleeve. An alternate embodiment uses a cord hung from the bracket in place of the hook. The process is then repeated for the other side of the window.

An object of the present invention is to provide a method for forming a bishop tail and a bishop sleeve decorative window treatments which can be performed by one person without any specialized skills or training.

Another object of the present invention is to provide a method for forming a bishop tail and a bishop sleeve decorative window treatments which can be adjusted to place the bishop tail and bishop sleeve at a desired height without requiring any specialized skills or training.

BRIEF DESCRIPTION OF THE DRAWINGS

These and other objects and advantages of the present invention are set forth below and further made clear by reference to the drawings, wherein:

FIG. 1 is an elevation view of the current invention showing the preferred embodiment of the adjustable bishop tail and bishop sleeve decorative window treatments applied to a window.

FIG. 2 is a perspective view showing loop tape being ironed on the front edge of the fabric and the parallel hemmed edges of the fabric.

FIG. 3 is a perspective view showing the retainer ring and threader being inserted into one of the hemmed edges of the fabric scarf.

DESCRIPTION OF THE PREFERRED EMBODIMENT

Figure 4:
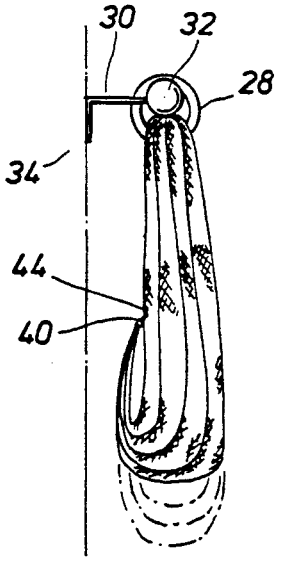
FIG. 4 is a perspective view showing the rear of the curtain rod with the pinch ring attached to the rear of the curtain fabric.

FIG. 1 shows a draped window W having a depending arc 10 of fabric 12 with bishop tails 14 and 16 arranged at either end in accordance with the method of the present invention. A pair of bishop sleeves 18 and 20 are formed in side scarfs 22 and 24 positioned on either end of fabric 12. The hardware required to practice the present invention includes rod 26, curtain rings 28, brackets 30 and decorative end pieces or finials 32. These items are of a conventional configuration, well known to those skilled in the art, whose construction and arrangement are shown in greater detail in U.S. Pat. No. 5,146,972 to William L. Tacchella, which specification is incorporated herein by reference.

The window treatment shown in FIG. 1 is formed by first attaching brackets 30 (best seen in FIG. 4) to a vertical wall 34 in spaced relationship to support rod 26 in a horizontal position and spaced from vertical wall 34. A suitable fabric attachment means such as hook pads are attached to the rear of rod 26 in an evenly spaced array to support the fabric 12 as shown in FIG. 3 of U.S. Pat. No. 5,146,972. Fabric 12 is measured and cut to cover the window opening W with sufficient extra fabric left on either side to form a "tail" as described hereinafter. The fabric 12 is then hemmed to form an open hemmed edge 36 and a fabric attachment means such as loop tape 38, complementary to the hook pads, is attached by ironing to the front face of fabric 12 as seen in FIG. 2. Loop tape 38 is centered on the edge of fabric 12 to allow forming the "tails" previously mentioned.

Fabric 12 is attached to rod 26 by pressing loop tape 38 into engagement with hook pads on the rear of rod 26. The extra portion of fabric 12 is suspended from rod 26 to form a tail of material at each end of the rod including open hemmed edge 36. The fabric tail is pulled through a curtain ring 28 which is then slid up the fabric tail to a position near the end of the rod 26. The depending arc 10 of fabric 12 is then "dressed" to form a series of folds as shown in FIG. 1.

Figure 5:
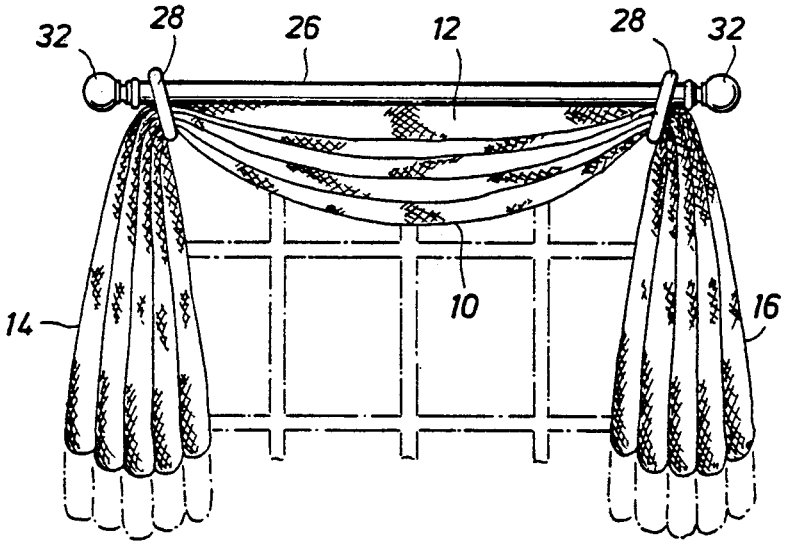
FIG. 5 is an elevation view of the preferred embodiment of the bishop tail showing the resulting decorative window treatment and adjustment.
Figure 4A:
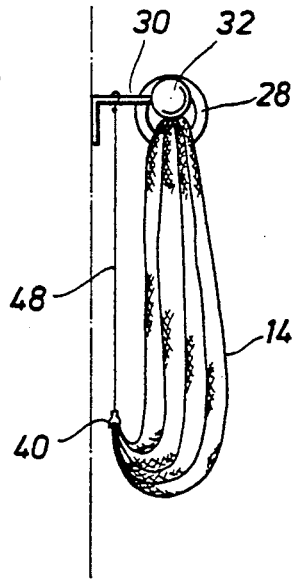
FIG. 4A is a perspective view showing the rear of the curtain rod with, an alternate adjusting means attached to the curtain rod bracket.

Hook closure 40, seen in FIG. 3, in combination with threader 42 allows the open hemmed edge 36 to be gathered onto hook closure 40. Threader 42 is a hollow tube sized to fit over the end of hook closure 40 to allow the feeding of hemmed edge 36 onto hook closure 40 without snagging. Hook closure 40 is then attached by suitable means as pinch ring 44 to the rear of bishop tail 14. Pinch ring 44 allows adjustment of the bishop tail 14 to the desired elevation. The process is repeated for the other end of fabric 12 to form a second bishop tail 16 as best seen in FIG. 5. An alternate means for adjusting bishop tail 14 is shown in FIG. 4A. Hook and cord 48 attaches hook closure 40 to bracket 30. Hook and cord 48 can then be adjusted to allow positioning of bishop tail 14 at the desired height.

Figure 6:
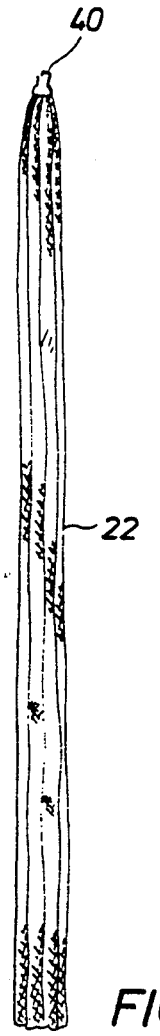
FIG. 6 is a perspective view showing a retainer ring and threader being inserted into one of the hemmed edges of the fabric scarf for forming a bishop sleeve.
Figure 7:
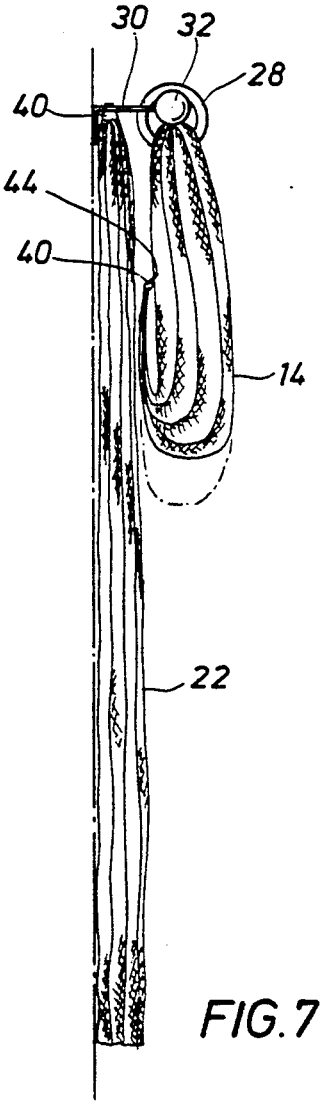
FIG. 7 is a perspective view showing the end of the rod with the retainer ring of the bishop sleeve attached to the rod bracket.
Figure 8:
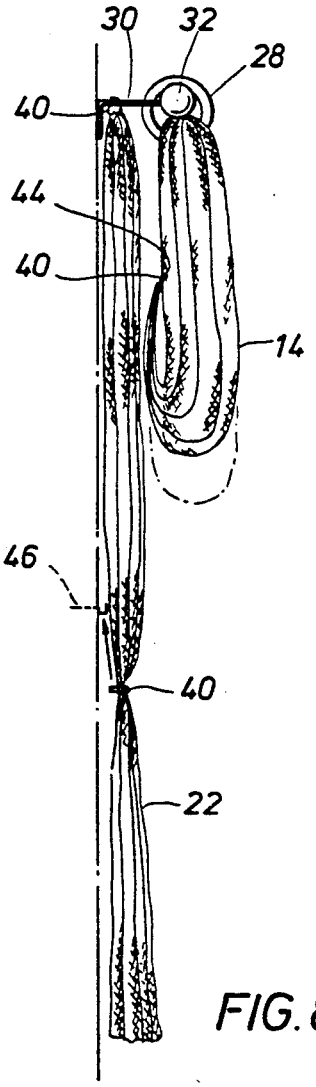
FIG. 8 is a perspective view showing a retainer ring having the gathered material of the bishop sleeve inserted into the retainer ring.
Figure 7A:
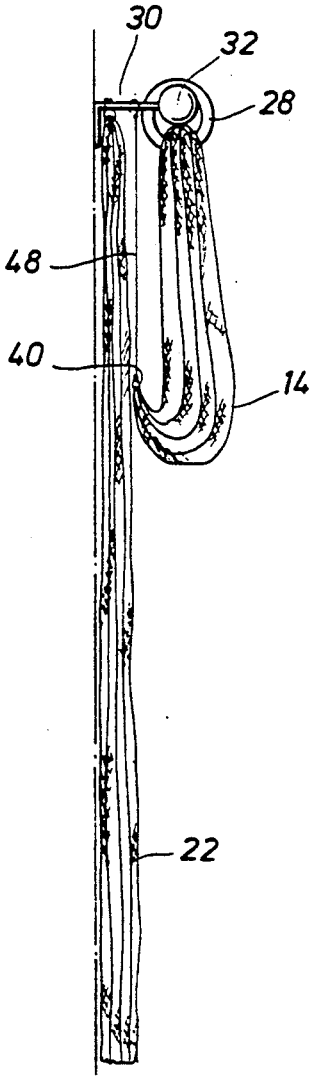
FIG. 7A is a perspective view showing the rear of the rod with the retainer ring of the bishop sleeve attached to the rod bracket and an alternate adjusting means attached to the rod bracket.
Figure 9:
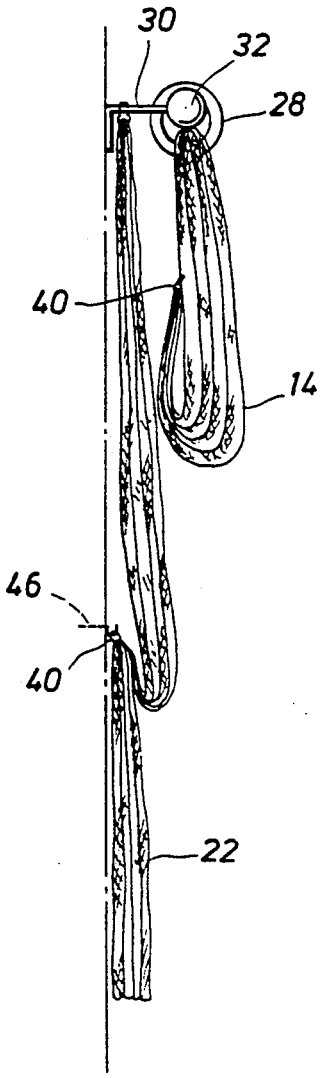
FIG. 9 is a perspective view showing the rear of the rod with the retainer ring of the bishop sleeve attached to the hook bracket.

As best seen in FIGS. 6, 7 and 8, a bishop sleeve may be formed on either side of window W. A side scarf 22 is formed by cutting and hemming a fabric portion of suitable size. A hemmed edge is threaded onto hook closure 40 with a threader 42. Hook closure 40 is attached to bracket 30 as seen in FIG. 7. A fabric retaining means as hook closure 40 is attached around the side scarf 22 a suitable distance below hook bracket 46 as shown in FIG. 8. The hook closure 40 is then attached to hook bracket 46 as best seen in FIG. 9. The process is repeated for the side scarf 24 to form a second bishop sleeve 20 as best seen in FIG. 1. An alternate means for adjusting bishop tail 14 is shown in FIG. 7A. Hook and cord 48 attaches hook closure 40 to bracket 30. Hook and cord 48 can then be adjusted to allow positioning of bishop tail 14 at the desired height.

Figure 10:
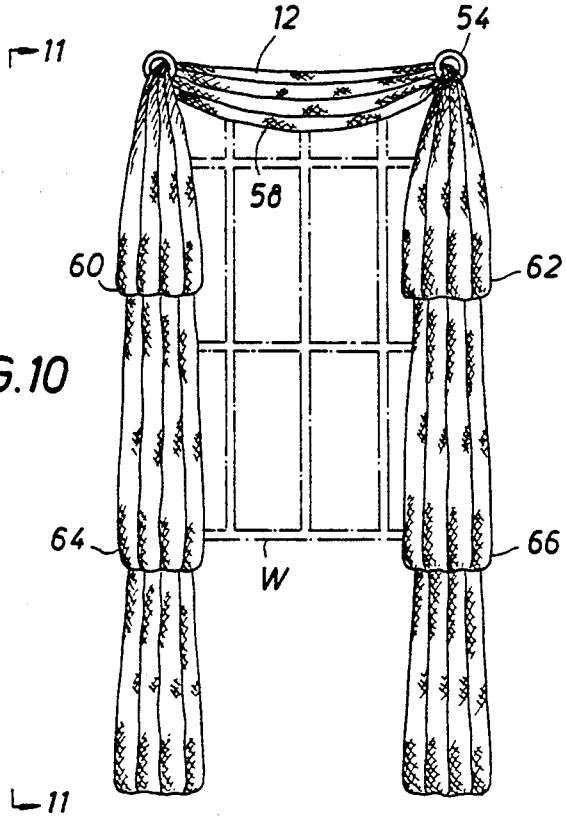
FIG. 10 is an elevation view of an alternate embodiment showing an adjustable bishop tail and bishop sleeve decorative window treatments on a scarf ring.
Figure 11:
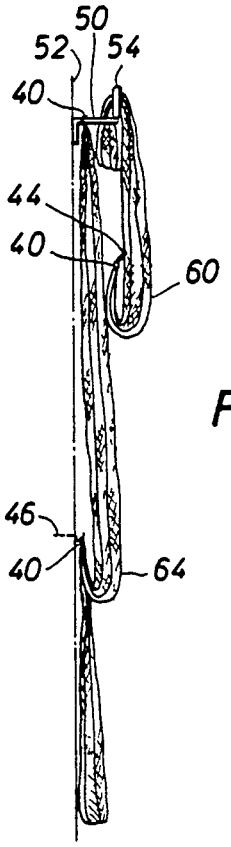
FIG. 11 is a perspective view of the alternate embodiment of FIG. 10 showing the side of the scarf ring with the retainer ring of the bishop tail attached to the rear of the bishop tail and the retainer ring of the bishop sleeve attached to the bracket installed in the wall.

A first alternate embodiment is shown in FIG. 10 and 11. This window treatment is formed by first attaching brackets 50 (best seen in FIG. 11) to a vertical wall 52 in spaced relationship to support scarf ring 54 in a horizontal position and spaced from vertical wall 52. Fabric 12 is measured and cut to cover the window opening W with sufficient extra fabric left on either side to form a "tail" as in the preferred embodiment. The fabric 12 is hemmed to form an open hemmed edge 36. Fabric 12 is attached by draping through scarf rings 54. The extra portion of fabric 12 is suspended from scarf rings 54 to form a tail of material at each end of the rod including open hemmed edge 36. The depending arc 58 of fabric 12 is then "dressed" to form a series of folds as shown in FIG. 10.

Hook closure 40 in combination with threader 42 allows the open hemmed edge 36 to be gathered onto hook closure 40 as in the preferred embodiment. Hook closure 40 is then attached by suitable means as pinch ring 44 to the rear of bishop tail 60. The process is repeated for the other end to form a second bishop tail 62 as best seen in FIG. 11. As in the preferred embodiment, a bishop sleeve 64 and 66 may be formed on either side of window W.

Figure 12:
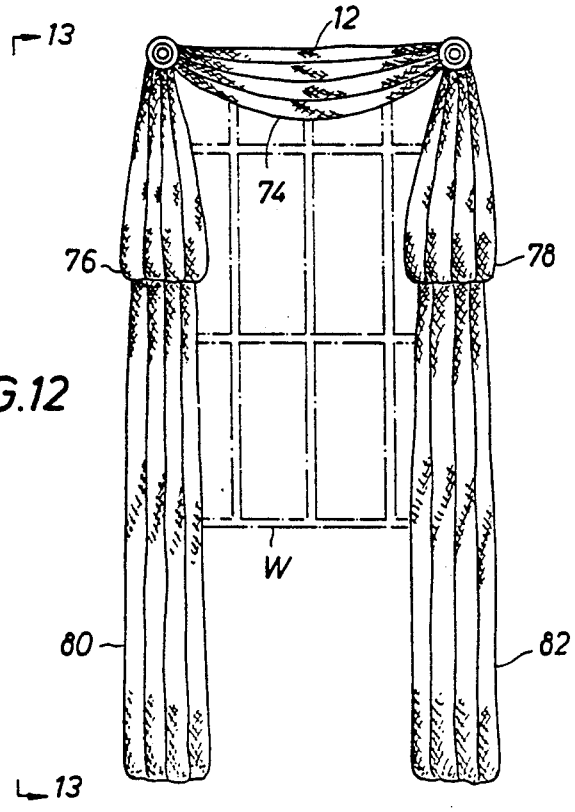
FIG. 12 is an elevation view of a second alternate embodiment showing an adjustable bishop tail and bishop sleeve decorative window treatments on a scarf holder.
Figure 13:
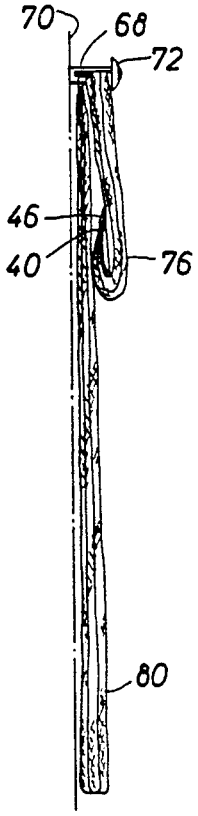
FIG. 13 is a perspective view of the second alternate embodiment of FIG. 12 showing the side of the scarf holder with the retainer ring of the bishop tail attached to the rear of the bishop tail and the retainer ring of the bishop sleeve attached to the bracket installed in the wall.

A second alternate embodiment is shown in FIG. 12 and 13. This window treatment is formed by first attaching brackets 68 (best seen in FIG. 13) to a vertical wall 70 in spaced relationship to support scarfholder 72 in a horizontal position and spaced from vertical wall 70. Fabric 12 is measured and cut to cover the window opening W with sufficient extra fabric left on either side to form a "tail" as in the preferred embodiment. The fabric 12 is then hemmed to form an open hemmed edge 36. Fabric 12 is attached by draping fabric 12 over brackets 68 and behind scarfholder 72. The extra portion of fabric 12 is suspended from scarfholders 72 to form a tail of material at each end of the rod including open hemmed edge 56. The depending arc 74 of fabric 12 is then "dressed" to form a series of folds as shown in FIG. 12.

Hook closure 40 in combination with threader 42 allows the open hemmed edge 36 to be gathered onto hook closure 40 as in the preferred embodiment. Hook closure 40 is then attached by suitable means as pinch ring 44 to the rear of bishop tail 76. The process is repeated for the other end to form a second bishop tail 78 as best seen in FIG. 12. Side scarfs 80 and 82 may be formed on either side of window W with attachment to bracket 68 by hook closure 40.

The construction of our improved method for forming a bishop tail and bishop sleeve and the methods of its application will be readily understood from the foregoing description and it will be seen we have provided an improved method for forming a bishop tail and bishop sleeve which can be performed by one person without any specialized skills or training. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A method for draping curtains comprising the steps of:

securing a pair of brackets to opposing sides of an opening in a substantially vertical wall above said opening wherein said brackets project outwardly from said wall to secure a fabric attachment means to said bracket, cutting and hemming opposite edges of a portion of fabric to form a fabric scarf of a size to allow said fabric scarf to cover said wall opening with a depending end portion suspended on either side of said wall opening, securing said fabric scarf to said brackets utilizing said fabric attachment means, forming a draping arc with said fabric scarf between said brackets, installing a gathering means through the first of said hemmed edges of said fabric scarf, connecting an adjusting means to said gathering means, adjusting said adjusting means to form a bishop tail with said first hemmed edge, installing a gathering means through the second of said hemmed edges of said fabric scarf, connecting an adjusting means to said gathering means, and adjusting said adjusting means to form a bishop tail with said second hemmed edge.

2. A method for draping curtains according to claim 1 further comprising the steps of:

cutting a portion of fabric to form a first fabric scarf, cutting a portion of fabric to form a second fabric scarf, hemming opposite edges of each of said first and said second fabric scarves, installing a gathering means through one of said hemmed edges of said first fabric scarf, attaching said gathering means of said first fabric scarf to said bracket, installing a gathering means through one of said hemmed edges of said second fabric scarf, attaching said gathering means of said second fabric scarf to said bracket, positioning a second gathering means around said first fabric scarf at a pre-determined location, connecting an adjusting means to said gathering means of said first fabric scarf, adjusting said adjusting means to form a bishop sleeve in said first fabric scarf, positioning a second gathering means around said second fabric scarf at a pre-determined location, connecting an adjusting means to gathering means of said second fabric scarf, and adjusting said adjusting means to form a bishop sleeve in said second fabric scarf.

3. A method for draping curtains according to claim 2 further comprising the steps of:

dressing said draping arc of fabric scarf to produce a series of folds in said draping arc.

4. A method for draping curtains according to claim 1 wherein said fabric attachment means includes:

a horizontally disposed rod secured to said brackets, an adhesive backed hook pad secured to the rear of said rod, and a heat activated adhesive backed loop tape secured to the rear of said fabric scarf.

5. A method for draping curtains according to claim 1 wherein said fabric attachment means includes:

a scarf ring positioned on each bracket.

6. A method for draping curtains according to claim 1 wherein said fabric attachment means includes:

a scarfholder positioned on each bracket.

7. A method for draping curtains comprising the steps of:

securing a pair of brackets to opposing sides of an opening in a substantially vertical wall above said opening wherein said brackets project outwardly from said wall to secure a fabric attachment means to said bracket, cutting a portion of fabric to form a first fabric scarf, cutting a portion of fabric to form a second fabric scarf, hemming opposite edges of each of said first and said second fabric scarves, installing a gathering means through one of said hemmed edges of said first fabric scarf, attaching said gathering means of said first fabric scarf to said bracket, installing a gathering means through one of said hemmed edges of said second fabric scarf, attaching said gathering means of said second fabric scarf to said bracket, positioning a second gathering means around said first fabric scarf at a pre-determined location, connecting an adjusting means to said gathering means of said first fabric scarf, adjusting said adjusting means to form a bishop sleeve in said first fabric scarf, positioning a second gathering means around said second fabric scarf at a pre-determined location, connecting an adjusting means to gathering means of said second fabric scarf, and adjusting said adjusting means to form a bishop sleeve in said second fabric scarf.

8. A method for draping curtains comprising the steps of:

securing a pair of brackets to opposing sides of an opening in a substantially vertical wall above said opening wherein said brackets project outwardly from said wall to secure a fabric attachment means to said bracket, cutting and hemming opposite sides of a portion of fabric to form a fabric scarf of a size to allow said fabric scarf to cover said wall opening with a depending end portion suspended on either side of said wall opening, securing said fabric scarf to said brackets utilizing said fabric attachment means, forming a draping arc with said fabric scarf between said brackets, installing a gathering means through the first of said hemmed edges of said curtain, connecting an adjusting means to said gathering means, adjusting said adjusting means to form a bishop tail with said first hemmed edge, installing a gathering means through the second of said hemmed edges of said fabric scarf, connecting an adjusting means to said gathering means, adjusting said adjusting means to form a bishop tail with said second hemmed edge, cutting a portion of fabric to form a first fabric scarf, cutting a portion of fabric to form a second fabric scarf, hemming opposite edges of each of said first and said second fabric scarves, installing a gathering means through one of said hemmed edges of said first fabric scarf, attaching said gathering means of said first fabric scarf to said bracket, installing a gathering means through one of said hemmed edges of said second fabric scarf, attaching said gathering means of said second fabric scarf to said bracket.

9. A method for draping curtains according to claim 8 further comprising the steps of:

dressing said draping arc of fabric scarf to produce a series of folds in said draping arc.

10. A method for draping curtains according to claim 8 wherein said fabric attachment means includes:

a horizontally disposed rod secured to said brackets, an adhesive backed hook pad secured to the rear of said rod, and a heat activated adhesive backed loop tape secured to the rear of said fabric scarf.

11. A method for draping curtains according to claim 8 wherein said fabric attachment means includes:

a scarf ring positioned on each bracket.

12. A method for draping curtains according to claim 8 wherein said fabric attachment means includes:

a scarfholder positioned on each bracket.

* * * * *